US008028871B2

(12) United States Patent
Gray

(10) Patent No.: US 8,028,871 B2
(45) **Date of Patent: *Oct. 4, 2011**

(54) BABY CARRIER

(76) Inventor: Jeanette Edith Gray, Provo, UT (US)

( * ) Notice: Subject to any disclaimer, the term of this patent is extended or adjusted under 35 U.S.C. 154(b) by 908 days.

This patent is subject to a terminal disclaimer.

(21) Appl. No.: 11/611,857

(22) Filed: Dec. 16, 2006

(65) Prior Publication Data

US 2008/0190972 A1 Aug. 14, 2008

(51) Int. Cl.
*A47D 13/02* (2006.01)

(52) U.S. Cl. ..... 224/160; 224/159; 224/158; 224/259; 224/260

(58) Field of Classification Search ..... 224/159, 224/160, 258, 259, 601, 602, 627, 631, 637, 224/643, 647, 656
See application file for complete search history.

(56) References Cited

U.S. PATENT DOCUMENTS 4,149,687 A * 4/1979 Nunemacher ..... 224/159
4,416,405 A * 11/1983 Caillouet ..... 224/257
4,434,920 A * 3/1984 Moore ..... 224/160
5,020,709 A * 6/1991 Hoaglan ..... 224/155
5,205,451 A * 4/1993 Manzer ..... 224/161
5,361,952 A * 11/1994 Gold ..... 224/159
5,673,828 A * 10/1997 Raedel et al. ..... 224/160
5,678,739 A * 10/1997 Darling et al. ..... 224/160
5,813,580 A * 9/1998 Fair ..... 224/160
6,409,060 B2 * 6/2002 Donine ..... 224/160
6,415,969 B1 * 7/2002 Higuchi ..... 224/160
6,595,396 B2 * 7/2003 Cummings et al. ..... 224/158
6,763,983 B2 * 7/2004 Norman ..... 224/160

OTHER PUBLICATIONS

Kapoochi "One Step Ahead: Thoughtfully Selected Products to Help With Baby . . . Every Step of the Way." Preferred Issue 1999. Kapoochi. <http://www.kapoochi.net/Merchant2/merchant.mvc?Screen=PROD&Store_Code=KB-1&Product_Code=24900&Category_Code=Kapoochi_0001> May 10, 2010.

* cited by examiner

*Primary Examiner* — Justin Larson
*Assistant Examiner* — Steven M Landolfi, Jr.
(74) *Attorney, Agent, or Firm* — Morris O'Bryant Compagni, P.C.

(57) ABSTRACT

A baby carrier comprising a shoulder harness featuring a detachable adjustable pouch system that may be worn or alternatively fastened to a secured object for supporting an infant. The shoulder harness features retractable shoulder straps that may be used to securely extend the detachable adjustable pouch system away from wearer without having to detach the pouch or remove the infant while simultaneously allowing the wearer face to face access with the infant. The detachable adjustable pouch system may encapsulate and support an infant in a substantially upright sitting position. The detachable adjustable pouch system may be adjusted to accommodate infants of varying sizes. The weight of the infant may be incorporated as a design component of the seat portion of the pouch system.

20 Claims, 7 Drawing Sheets

BABY CARRIER

The following Non-Provisional Application is referenced back to Provisional Application Ser. No. 06/597,677 entitled "Baby Carrier".

BACKGROUND OF THE INVENTION

The present invention relates to an improved soft baby carrier in which an infant can be safely carried by its parent or fastened to a secure object. One of the many situations which a modern-day parent has to contend with is trying to manage everyday activities while also trying to care for their infant child. Many parents may find themselves in a predicament where they have to temporarily forego whatever activity they are currently engaged in while they tend to the needs of their little one, or vice versa. Various baby carriers have been developed over the years as a means of allowing parents to accomplish many of these activities simultaneously by providing a carrying arrangement attached to the parent that may allow the parent use of their arms to perform other activities as needed, while the infant is safely secured within the baby carrier. Soft baby carriers typically incorporate an arrangement of fabric or similar material that is formed to cradle an infant that may then be attached to the wearer. Some arrangements may be worn on the front, side or back of the torso depending on the design. Despite various improvements over the years, many soft baby carriers still lack ease of use and the ability to be adjusted quickly to accommodate infants and parents of different sizes and shapes.

U.S. Pat. No. 5,361,952 by Gold, which is herein incorporated by reference for all that it contains, discloses a soft-type baby carrier for supporting a baby in a rearwardly facing direction on the front or side torso of a wearer. The baby carrier includes an adjustable pouch shaped baby seat for supporting a baby in a substantially upright, sitting position, an adjustable waist belt and an adjustable yoke system for comfortably supporting the baby carrier about the neck of a wearer.

U.S. Pat. No. 7,070,076 by Bergkvist, which is herein incorporated by reference for all that it contains, discloses pertaining to a child-supporting shoulder harness including a flexible front piece which is connected in the harness to form a child supporting pouch. The front piece includes a length-adjustable connecting device which extends between two horizontal, mutually spaced points on the front piece, so as to enable the width of the pouch to be varied. When the width is reduced, the lateral end-parts of the front piece are deformed in a way that reduces the wedging action between the wearer's chest and the baby's head and provides a comfortable lateral head support for a sleeping baby.

BRIEF SUMMARY OF THE INVENTION

The present invention comprises an improved soft baby carrier comprising an adjustable shoulder harness featuring a detachable adjustable pouch system. The baby carrier may be worn or alternatively fastened to a secured object for supporting an infant. The detachable adjustable pouch system may also be detached from the shoulder harness and fastened to a secure object for supporting an infant.

In one aspect of the invention the adjustable shoulder harness may incorporate retractable shoulder straps disposed in the front portion of the harness that may be used to safely and securely extend the pouch system away from the wearer without having to detach the pouch or remove the infant. The retractable shoulder straps may allow the pouch system to be quickly and conveniently extended away from the wearer providing face to face interaction with the infant while also creating extra room for the infant to move. The pouch may also be retracted just as quickly into its original position once the needs of the infant are addressed or at such time that the infant is once more settled, allowing the parent to carry on with the task at hand. The detachable adjustable pouch system may form a seat for supporting an infant in a substantially upright seated position that may be adjusted to accommodate an infant of varying sizes. The pouch may be adjusted to fit an infant by utilizing a retractable drawstring system disposed in the seat portion and adjustable straps disposed in the side portions both of which may be adjusted to provide more or less depth and width for the infant. The adjustable pouch system may also incorporate the weight of the infant as a design feature of a fastening system in the seat portion.

DETAILED DESCRIPTION OF THE INVENTION AND THE PREFERRED EMBODIMENT

It will be readily understood that the components of the present invention, as generally described and illustrated in the Figures herein, may be arranged and designed in a wide variety of different configurations. Thus, the following, more detailed description of embodiments of the apparatus of the present invention, as represented in the Figures is not intended to limit the scope of the invention, as claimed, but is merely representative of various selected embodiments of the invention.

Figure 1:
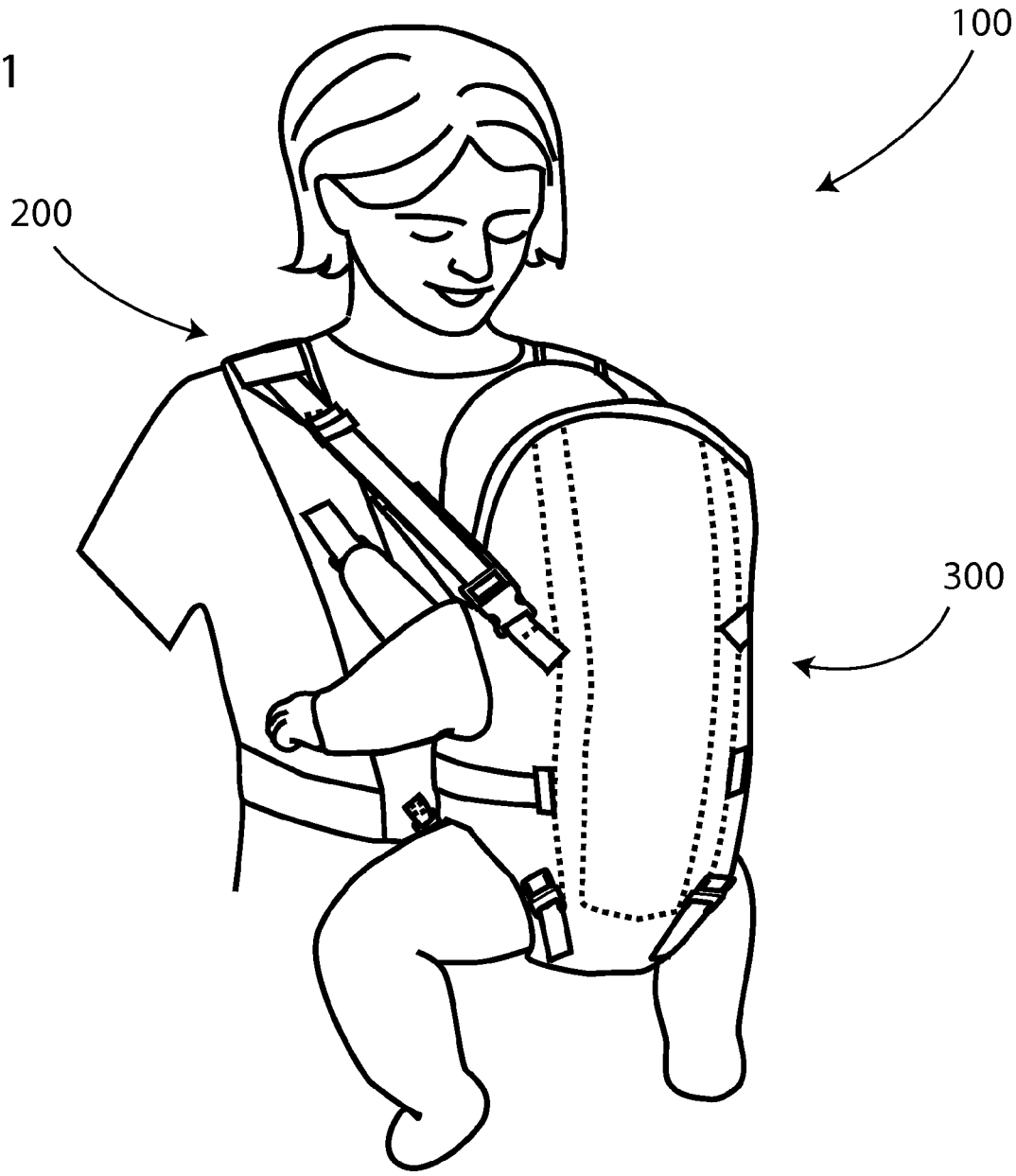
FIG. 1 is a perspective diagram of an embodiment of a baby carrier.
Figure 2:
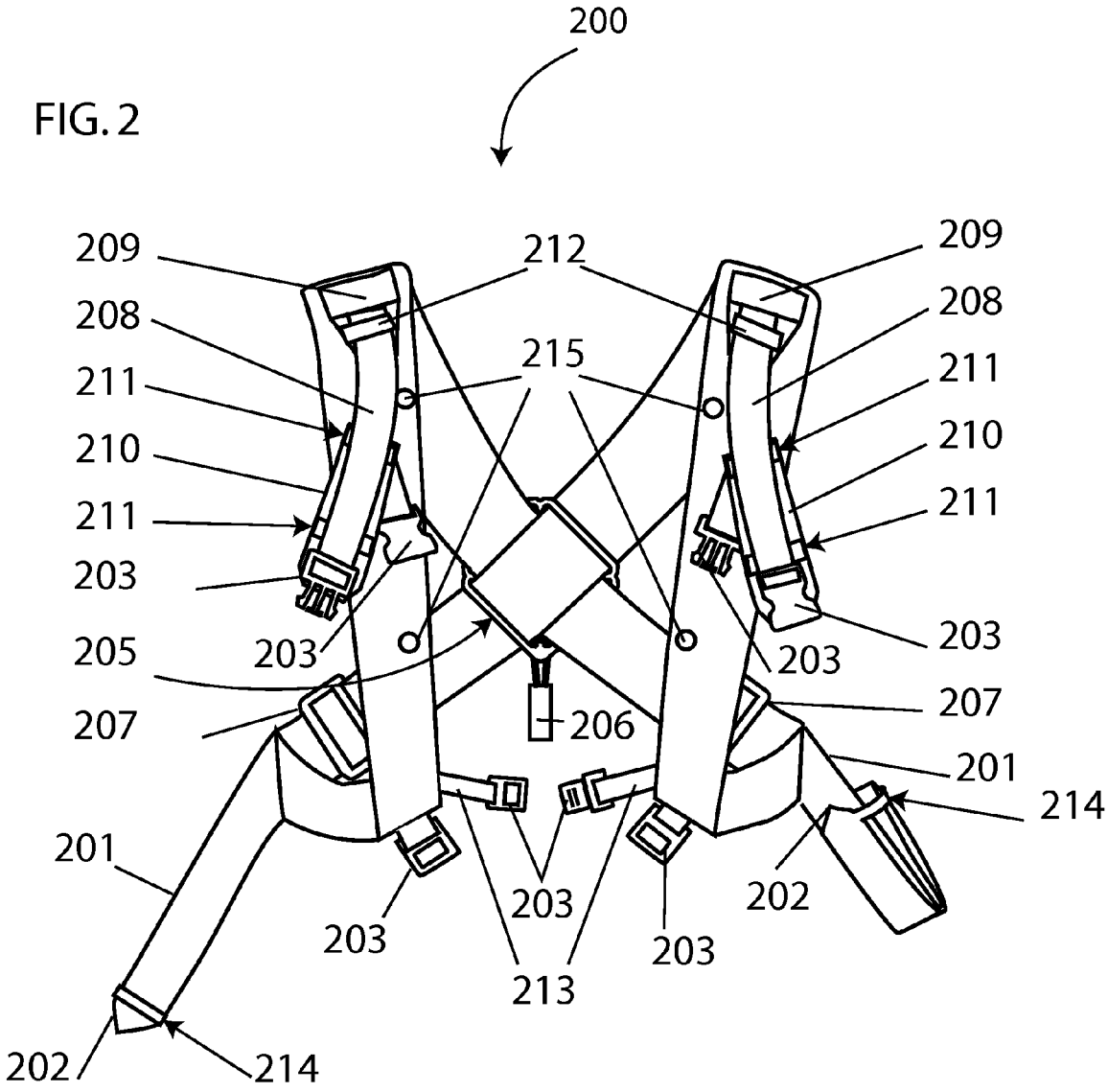
FIG. 2 is a perspective diagram of an embodiment of an adjustable shoulder harness.

FIG. 1 discloses an embodiment of the current invention depicting a soft baby carrier 100 comprising an adjustable shoulder harness 200 and a detachable adjustable pouch system 300 in which an infant can be safely carried by its parent or fastened to a secure object. FIG. 2 discloses an embodiment of the current invention depicting an adjustable shoulder harness 200. The shoulder harness 200 may comprise an arrangement of at least two adjustable straps 201 comprising two ends 202, a front and rear portion, with a plurality of fastening fixtures 203 disposed at the front portion of said arrangement. In some embodiments the arrangement may comprise at least two adjustable straps 201 that form a figure 8-shaped arrangement. The two adjustable straps 201 may comprise thick padded fabric of substantially equally lengths. The two adjustable straps 201 may intersect through an intersection 205 that may also comprises an appendage 206 attached to the intersection 205 disposed towards the rear portion of the arrangement that may be utilized to hold the shoulder harness 200 in conformity. The thick padded fabric may serve to cushion both the wearer and the infant while the intersection 205 may assist to hold the arrangement in place, providing both fit and comfort during long periods of use. The two adjustable straps 201 may comprise buckles 207 disposed towards the rear of portion of the arrangement that are utilized to provide slack or take up any excess slack in the arrangement such that the shoulder harness 200 conforms to the torso of the wearer. The plurality of fastening fixtures 203 may be disposed generally at the front portion of the shoulder harness 200 and may comprise male or female connections selected from the group consisting of plastic domes, metal domes, plastic clips, metal clips, plastic hooks, metal hooks or combinations thereof. In a preferred embodiment the plurality of fastening fixtures 203 may comprise plastic clips that may also be configured to complement the at least one fastening fixtures of the detachable adjustable pouch system (not shown).

Also depicted are the at least two retractable shoulder straps 208 that may be disposed at the front of the adjustable shoulder harness 200 comprising separate fastening fixtures 203 at each end. In some embodiments the separate fastening fixtures 203 disposed at the end of the at least two retractable shoulder straps 208 may comprise a means to enable each end to be extended or retracted. In a preferred embodiment the at least two retractable straps 208 may comprise nylon strapping attached to a piece of fabric 209 subsequently attached in the upper portion of the adjustable shoulder harness 200. The piece of fabric 209 may be utilized to enable the at least two retractable shoulder straps 208 to withstand the effects of separating from the shoulder harness 200 after prolonged usage. The at least two retractable straps 208 may further comprise a sliding padded rectangular fabric strip 210 that may be attached using loops 211 with stops 212 forming the ends. The loops 211 may assist to keep two retractable straps 208 secure while the stops 212 may prevent the two retractable straps 208 from disconnecting from the shoulder harness 200. In some embodiments the fabric strips 210 may provide extra cushioning to prevent chaffing that may occur to an infant when the detachable adjustable pouch system (not shown) is attached to the adjustable shoulder harness 200.

Two small fastening fixtures 203 may be configured to connect at a lower front portion of the arrangement. The two small fastening fixtures 203 may be attached to elastic straps 213 that are attached at a lower portion of the arrangement. The two smaller fastening fixtures 203 may assist the shoulder harness 200 to conform better to the torso of the wearer and provide an improved fit. The two adjustable straps 201 may further comprise ends 202 with elastic straps 214 that may be utilized to secure any extra length of strap not being utilized. In other embodiments a bib (not shown) may be attached by plastic domes 215 disposed in the front portion of the shoulder harness 200 which may correspond to the chest area of the wearer. The bib may act as a shield between the infant and the wearer and prevent stains from lodging on the wearer's clothes.

Figure 3:
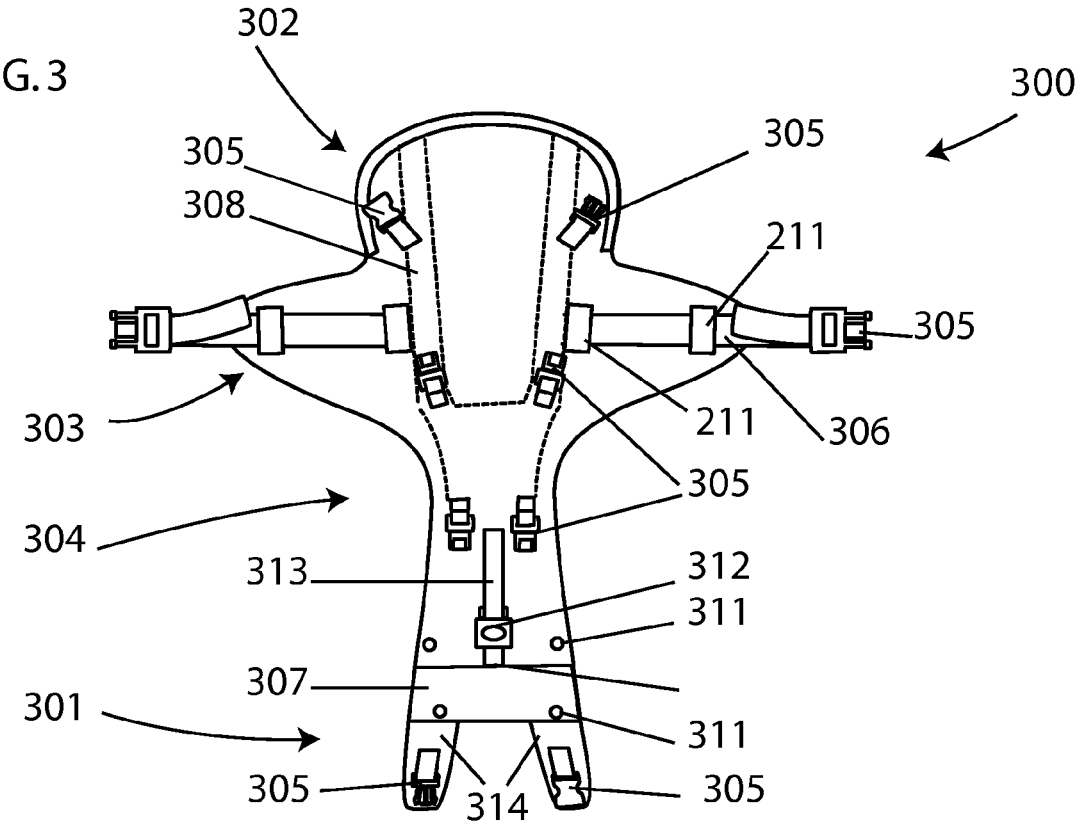
FIG. 3 is a perspective diagram of an embodiment of the detachable adjustable pouch system exterior.

FIG. 3 discloses another embodiment of the current invention depicting the exterior of a detachable adjustable pouch system 300 comprising a front 301, back 302, side 303 and seat 304 portions. Each portion may comprise at least one fastening fixture 305. The side portions 303 may comprise retractable straps 306 with fastening fixtures 305 disposed at each end. A retractable drawstring system 308 may be disposed within the back portion 302. The pouch system 300 may comprise padded fabric in a generally T-shaped configuration. The front portion 301 of the pouch system 300 may be formed towards the bottom of the T-shaped configuration and comprise a forked portion 314 that may further comprise at least one fastening fixture 305 that complements the at least one of the plurality of fastening fixtures 203 located on the shoulder harness. The forked portion 314 may further comprise a retractable partition 307 comprising padded fabric that may be extended and attached to plastic domes 311 in an upper portion of the forked portion 314 or retracted and secured using another set of plastic domes 311 in a lower portion of the forked portion 314. The retractable partition 307 may allow the pouch to extend to provide more depth in the seat portion 304 that may also allow more leg room for a larger infant and assist to keep the shoulder straps in place. A sliding fastening fixture 312 attached to a restraining loop 313 may also be disposed on the exterior of the front portion 301. The sliding fastening fixture 312 may be adjusted to connect with the at least one fixtures 305 disposed at the ends of the retractable straps 306 disposed in the side portions 303 of the pouch system 300 to accommodate an infant and provide a better fit.

The back 302 and side 303 portions of the pouch system 300 may be formed in the upper portion of the T-shaped configuration and may comprise at least one fastening fixture 305 that complements at least one of the plurality of fastening fixtures 203 located on the adjustable shoulder harness 200. The retractable straps 306 may comprise nylon straps attached to the back 302 portion of the pouch system 300. The retractable straps 306 may also comprise fabric loops 211 that may be utilized to secure any extra length of the nylon strap not be used to secure the infant in the pouch system 300. The seat 304 portion may be formed generally in the middle of the T-shaped configuration and may comprise at least one male fastening fixture 305 disposed on the exterior of said portion. In a preferred embodiment the seat portion 304 may comprise four male fastening fixtures 305 for connection with at least one of the plurality of fastening fixtures 203 of the adjustable should harness 200.

Figure 4:
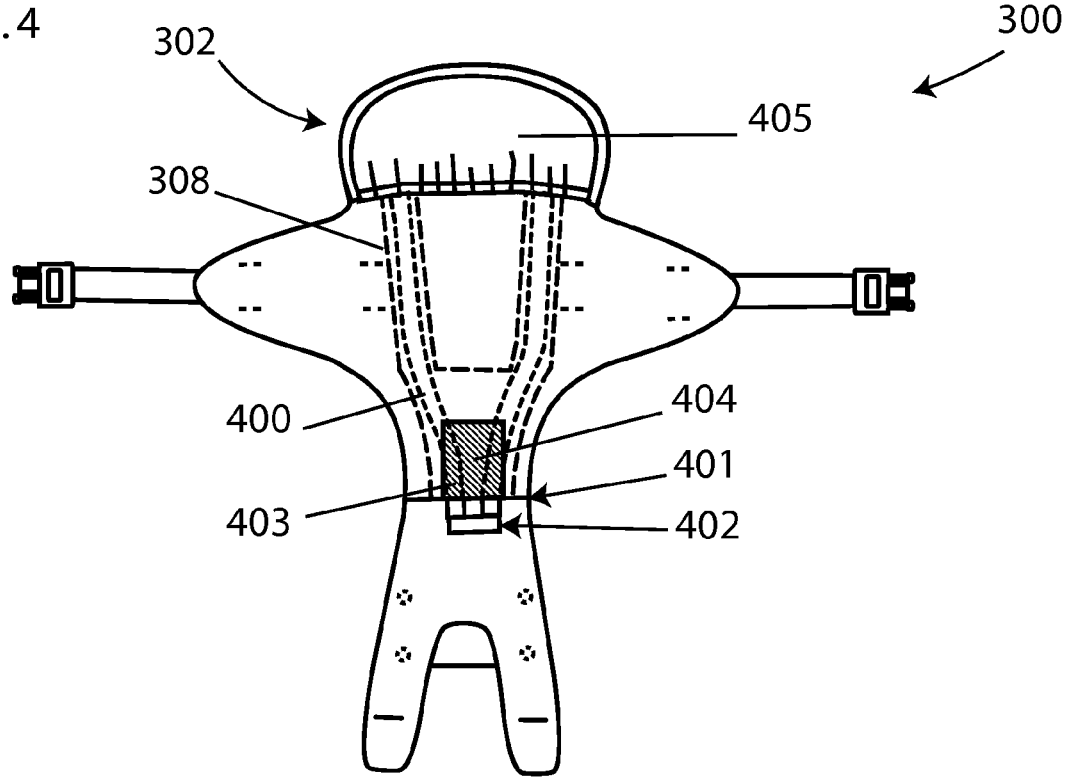
FIG. 4 is a perspective diagram of another embodiment of the detachable adjustable pouch system interior.

FIG. 4 discloses another embodiment depicting the interior portion of the pouch system 300 that may comprise a padded fabric that provides both comfort and warmth. The interior may be sufficiently void of any sharp or hard objects and lay substantially flat for receiving an infant. The embodiment also discloses the retractable drawstring system 308 which may further comprise retractable drawstrings 400 that may subsequently be disposed within channels that form a generally V-shaped configuration. The ends of the retractable drawstrings 400 may be attached and anchored to the back 302 portion of the pouch system 300. The channels may be formed to accommodate the retractable drawstrings 400 so they have limited movement in a selected direction. The retractable drawstrings 400 may be selected from the material consisting of string, fabric tubing, nylon strapping, or combinations thereof. The retractable drawstrings 400 may be attached at their ends to a portion of the back 302 portion of the pouch system 300 that extends to an opening 401 where a strip comprising a pull tab 402 is attached at the apex of the V-shaped configuration. The retractable drawstrings 400 may be pulled up to 10 inches in a downward direction towards the forked portion 314 of the pouch system 300 or alternatively retracted back to their original starting position. The retractable drawstrings 400 may also comprise strips of a self adhesive material 403 that begin proximate the pull tab 402 and extend up to 10 inches towards the back 302 portion. In some embodiments the self adhesive material 403 may comprise Velcro hooks. A corresponding self adhesive pad 404 may be attached to the interior seat 304 portion of the adjustable pouch system 300. In some embodiments the corresponding self adhesive pad 404 may comprise Velcro padding. The back 302 portion of the pouch system 300 may also comprise an elasticized band that forms a pocket 405 in which the pouch system 300 may be rolled and stowed away.

Figure 5:
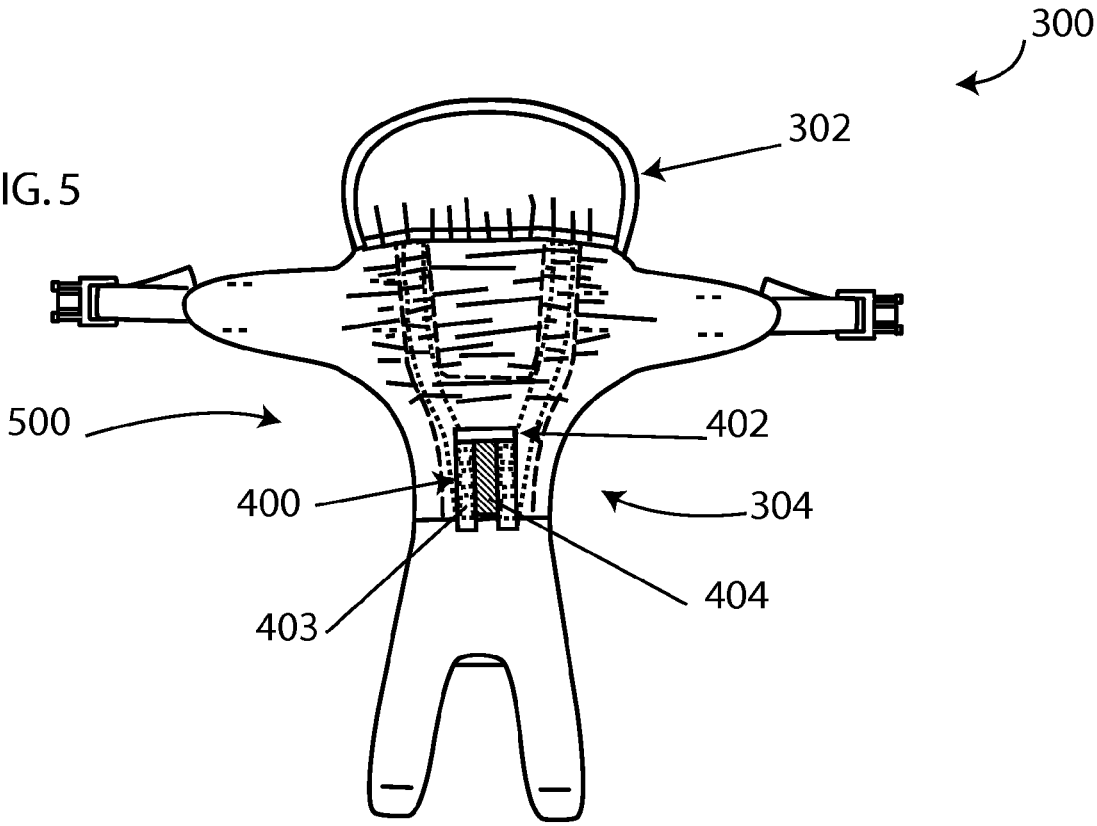
FIG. 5 is a perspective diagram of another embodiment of the detachable adjustable pouch system.

FIG. 5 discloses an embodiment of the detachable adjustable pouch system 300 depicting a fastening system 500 that may be utilized to adjust the depth of the pouch system 300. The fastening system 500 may comprise strips of self adhesive material 403 disposed on one side of the retractable drawstrings 400 that may be pulled and folded back towards the back 302 portion to be affixed to the self adhesive pad 404 disposed in the interior seat 304 portion of the pouch system 300. The fastening system 500 is disposed in the seat 304 portion of the pouch system 300 which may be disposed underneath the bottom of the infant and may utilized to incorporate the weight of the infant as a component to help keep the self adhesive material 403 and the self adhesive pad 404 affixed to one another. In some embodiments the fastening system 500 may also provide an extra layer of padding in the seat 304 portion.

Figure 6:
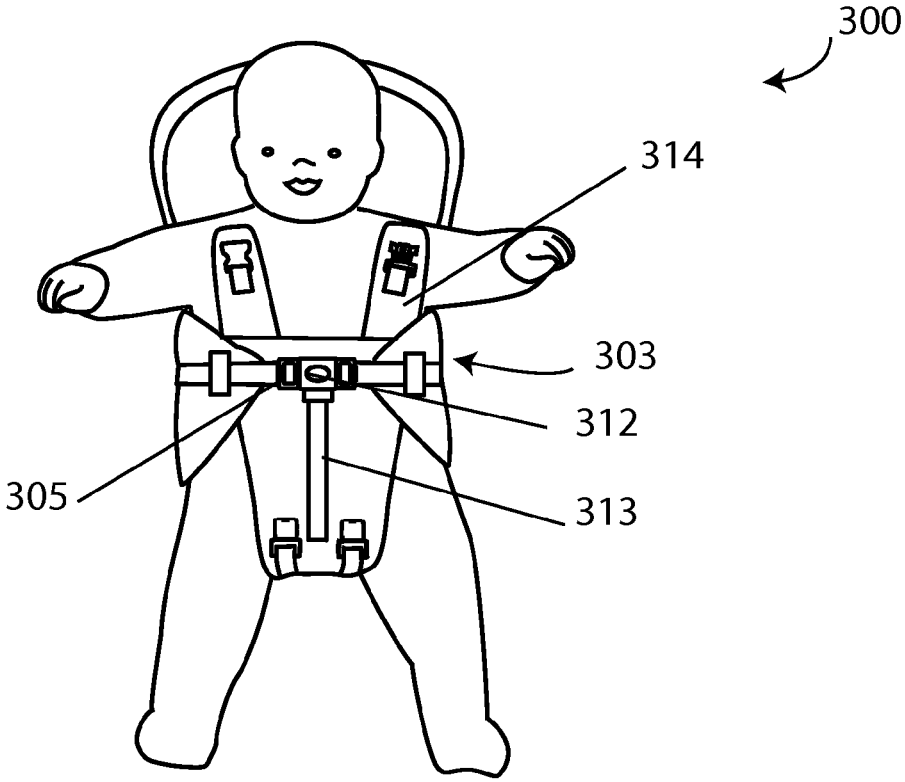
FIG. 6 is a perspective diagram of another embodiment of the detachable adjustable pouch system.

FIG. 6 discloses an embodiment of the baby carrier 100 depicting the adjustable pouch system 300 secured around an infant. In a preferred embodiment the pouch system 300 may comprise padded fabric in a generally T-shaped configuration with the front 301 portion being disposed towards the lower portion of the T-shaped configuration which may also comprise a forked portion 314. The forked portion 314 may be folded inwards towards the back 302 portion with the fastening fixtures 305 being disposed on the exterior of the pouch system 300. The side 303 portions may be formed in the upper portion of the T-shaped configuration and may be folded inwards to intersect with the forked portion 314. The embodiment further depicts how the T-shaped configuration may form the pouch system 300 that is utilized to support an infant. The side 303 portions may be used to wrap underneath the infants arms and around the torso while the fastening fixtures 305 disposed at each end may be configured to connect with the sliding fastening fixture 312 attached to the restraining loop 313 of the front 301 portion. In this embodiment the adjustable pouch system 300 may encapsulate and support an infant in a substantially upright sitting position that can be attached to the adjustable shoulder harness 200 or a secure object.

Figure 7:
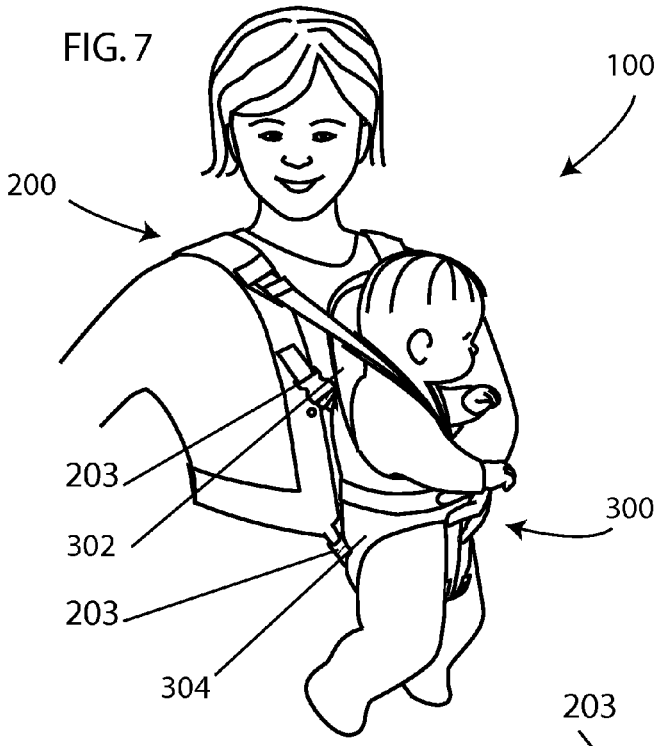
FIG. 7 is another perspective diagram of an embodiment of the detachable adjustable pouch system attached to the shoulder harness.
Figure 8:
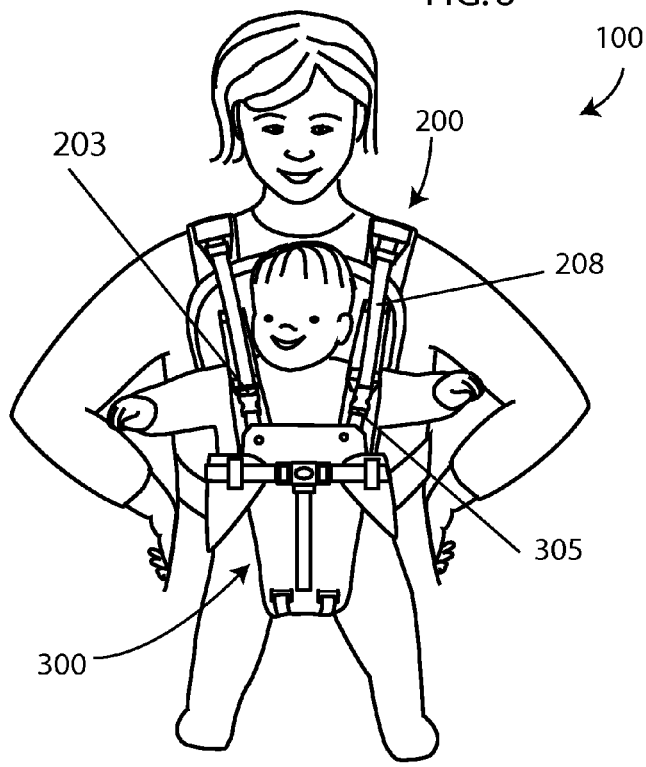
FIG. 8 is another perspective diagram of an embodiment of the detachable adjustable pouch system attached to the shoulder harness.

FIGS. 7-8 disclose an embodiment of the baby carrier 100 depicting the detachable adjustable pouch system 300 attached to the adjustable shoulder harness 200 in a forward facing position where the infant may be positioned forward facing. In this embodiment the adjustable pouch system 300 comprising the plurality of fastening fixtures 305 may be attached to the adjustable shoulder harness 200 using the at least one fastening fixtures 203. In a preferred embodiment the pouch system 300 may be attached to the adjustable shoulder harness 200 using twelve fastening fixtures which may comprise the separate fastening fixtures 203 disposed at each end of the at least two retractable shoulder straps 208 that complement two fastening fixtures 305 disposed in the forked portion 314 of the adjustable pouch system 300. Two fastening fixtures 203 disposed at the lower front portion of the adjustable shoulder harness 200 may be coupled with two fastening fixtures 305 disposed in the seat 304 portion of the pouch system 300. While two additional fastening fixtures 203 located intermediate the at least two retractable shoulder straps 208 and the lower portion of the adjustable shoulder harness 200 may be coupled with two additional fastening fixtures 305 disposed at the rear of the back 302 portion of the pouch system 300. Referring now to FIG. 8 which discloses a baby carrier 100 wherein the adjustable shoulder harness 200 comprising separate fastening fixtures 203 disposed at the end of the at least one retractable shoulder straps 208 may be coupled with the fastening fixtures 305 disposed in the forked portion 314 of the pouch system 300 in a forward facing position. In this embodiment the at least two retractable shoulder straps 208 may help to secure the upper torso area of an infant and prevent the child from falling out of the carrier.

Figure 9:
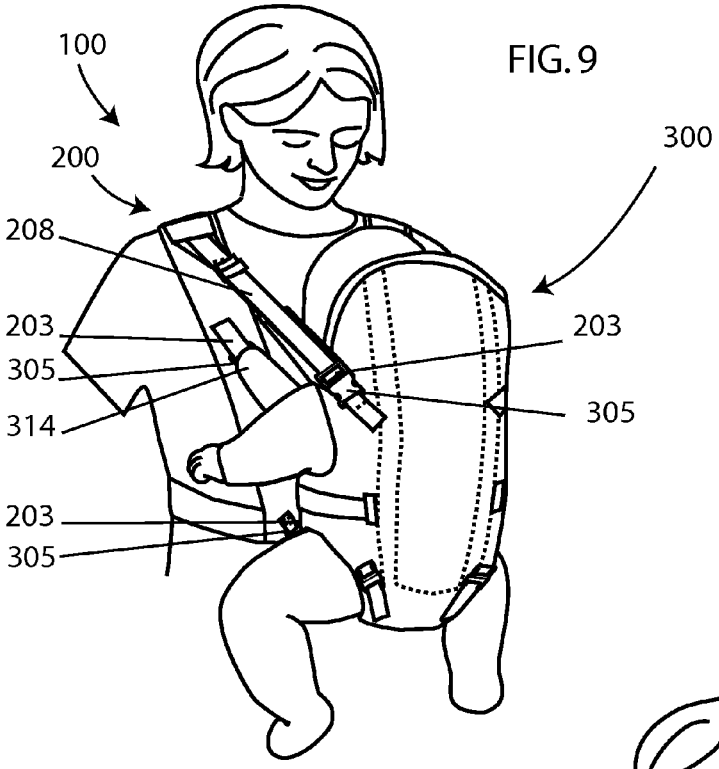
FIG. 9 is another perspective diagram of an embodiment of the detachable adjustable pouch system attached to the shoulder harness.
Figure 10:
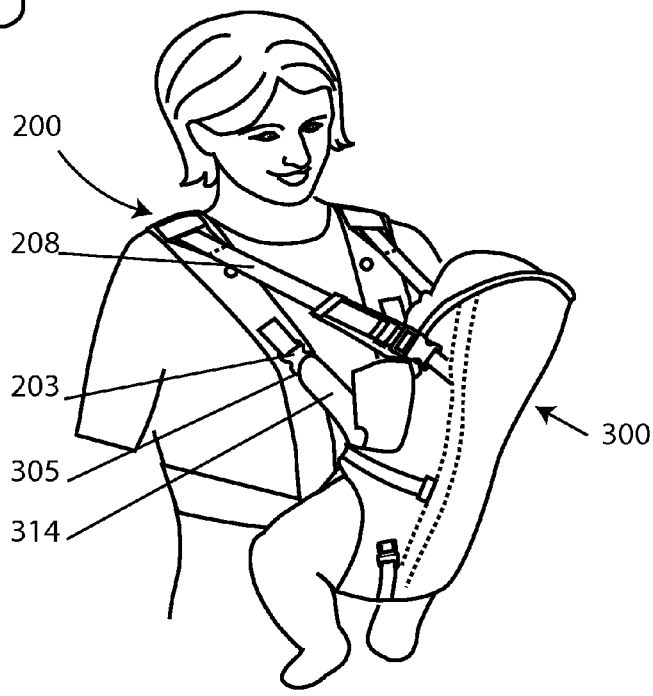
FIG. 10 is another perspective diagram of an embodiment of the detachable adjustable pouch system attached to the shoulder harness.

FIGS. 9-10 disclose an embodiment of the baby carrier 100 depicting the detachable adjustable pouch system 300 attached to the adjustable shoulder harness 200 in a rearward facing position where the infant may face towards the wearer. In a preferred embodiment the pouch system 300 may be attached to the adjustable shoulder harness 200 using a combination of fastening fixtures which may comprise the separate fastening fixtures 203 disposed at each end of the at least two retractable shoulder straps 208 coupled with the at least one fastening fixtures 305 disposed in the back 302 portion of the pouch system 300. The two fastening fixtures 203 disposed at the lower front portion of the adjustable shoulder harness 200 may be coupled with two fastening fixtures 305 disposed in the front of the seat 304 portion of the pouch system 300 while two more fastening fixtures 203 located intermediate the at least two retractable shoulder straps 208 and the lower portion of the shoulder harness 200 are coupled with the at least one fastening fixtures 305 disposed in the forked portion 314 of the adjustable pouch system 300. Referring now to FIG. 9 which depicts how the at least two retractable shoulder straps 208 may allow the pouch system 300 to be extended at least 2 inches from the adjustable shoulder harness 200. This may be accomplished by utilizing separate fastening fixtures 203 that comprise a means to extend or retract the at least two retractable shoulder straps 208, wherein the means may comprise one of the following consisting of a plastic sliding loop mechanism, a metal sliding loop mechanism, an elasticized member, an adjustable Velcro strap, or combinations thereof. The means may allow the pouch system 300 to be securely extended away from wearer without having to detach said pouch system 300 or remove the infant, while simultaneously allowing the wearer face to face access with the infant. In some embodiments the retractable shoulders straps 208 may allow the wearer quick face to face access to the infant in order to tend to the infants needs as well as provide extra room for the infant to move should the need arise.

Figure 11:
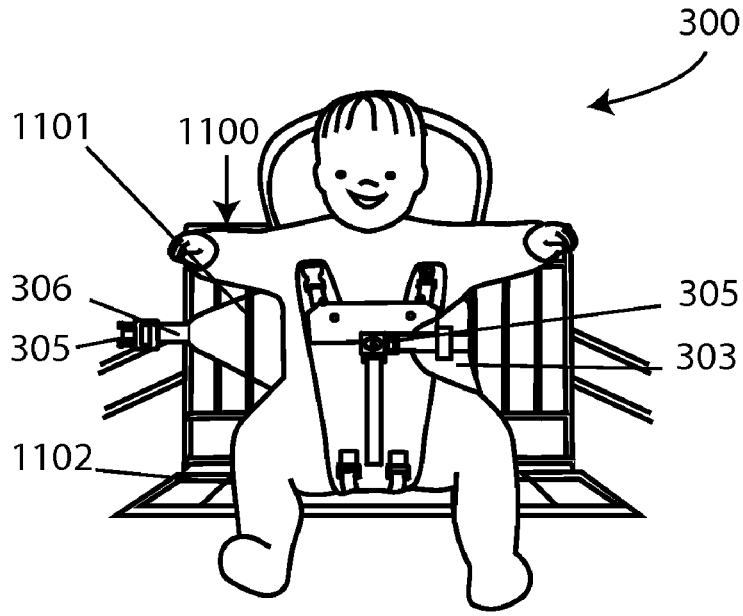
FIG. 11 is a perspective of an embodiment of the detachable adjustable pouch system attached to a secure object.
Figure 12:
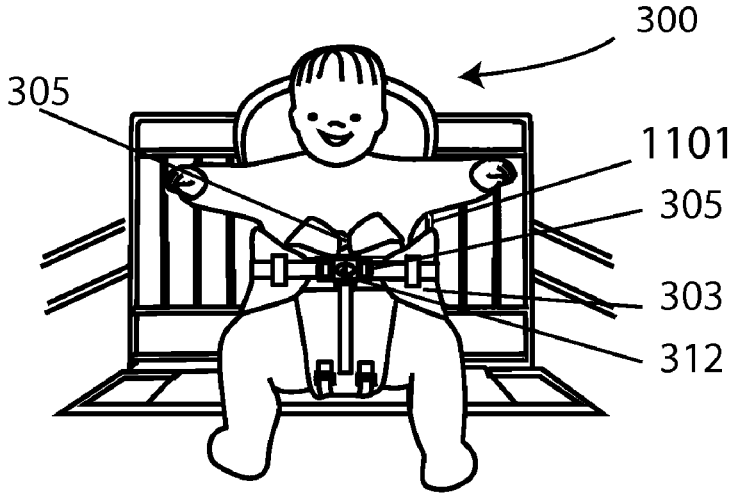
FIG. 12 is another perspective of an embodiment of the detachable adjustable pouch system attached to a secure object.

FIGS. 11-12 disclose an embodiment depicting the detachable adjustable pouch system 300 fastened to the back rest of a shopping cart 1100 being disposed atop the seat 1102 portion of the shopping cart 1100. FIG. 11 depicts how the side 303 portions may be threaded through the metal bars 1101 of the back rest of a shopping cart 1100 using the retractable straps 306 with the at least one fastening fixtures 305 disposed at each end. FIG. 12 depicts how the at least one fastening fixtures 305 may then be connected to the sliding fastening fixture 312 disposed in the front 301 portion of the pouch system 300 such that an infant may be substantially secured. In some embodiments the fastening fixtures 305 disposed in the forked portion 314 of the pouch maybe connected together to prevent finger entrapment.

Figure 13:
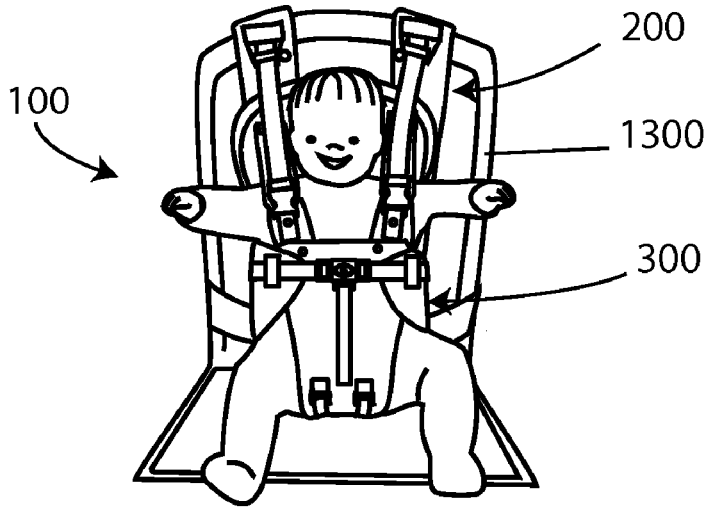
FIG. 13 is a perspective diagram of an embodiment of the adjustable shoulder harness attached to the detachable adjustable pouch system attached to a secure object.

FIG. 13 discloses an embodiment of the baby carrier 100 depicting the detachable adjustable pouch system 300 attached to the adjustable shoulder harness 200 in a forward facing position where the adjustable shoulder harness 200 may be adapted to attach to a secure object such as a high backed chair 1300. The adjustable shoulder harness 200 may be adjusted to fit securely around the back of a chair 1300 so that the pouch system 300 may be attached to support an infant.

Whereas the present invention has been described in particular relation to the drawings attached hereto, it should be understood that other and further modifications apart from those shown or suggested herein, may be made within the scope and spirit of the present invention.

What is claimed is:

1. A baby carrier, comprising;

an adjustable shoulder harness comprising a pair of adjustable straps, each adjustable strap having a shoulder portion configured for extending over a respective shoulder of a user, a front portion for extending over at least a chest of the user, a rear portion configured for extending around the back of the user and a waist portion configured for positioning proximate a waist of the user, the front portions extending in front of the user, continuously from the shoulder portions to the waist portions, the at least two adjustable straps being laterally spaced along the front portions when positioned over the chest of the user;

a plurality of fastening fixtures coupled to the front portions of the shoulder harness, the plurality of fastening fixtures comprising a first pair of fastening fixtures, each of the first pair of fastening fixtures respectively coupled to the pair of adjustable straps at the waist portion thereof and a second pair of fastening fixtures, each of the second pair of fastening fixtures respectively coupled to the pair of adjustable straps at the front thereof at a position downwardly spaced from the shoulder portion;

a pair of selectively retractable and extendable shoulder straps, each having a first end coupled to a respective one of the pair of adjustable straps proximate the shoulder portion thereof and a second free end being adjustable proximate the second free end;

a third pair of fastening fixtures, each coupled to a respective one of the pair of selectively retractable and extendable shoulder straps;

a detachable pouch comprising:

a front portion configured for extending over at least a portion of a front side of a torso of a child;

a back portion including a head supporting portion;

a seat portion interposed between the front portion and the back portion, the seat portion configured to extend between the legs of the child, laterally extending side portions extending laterally from the back portion configured to at least partially wrap around the torso of the child and over the front portion to hold the front portion against the front side of the torso of the child;

at least one adjustable strap coupled to the laterally extending side portions for securing the laterally extending side portions about the torso of the child;

a pair of spaced apart upwardly extending portions coupled to the front portion, the pair of spaced apart upwardly extending portions each including a second corresponding fastening fixture at a free end thereof configured for respective attachment to one of the second pair of fastening fixtures so that when the pouch is attached to the harness the free end of each upwardly extending portion extends to the front portion of the harness at a location approximately at least as high as a shoulder of the child to provide torso support for the child;

a first pair of corresponding fastening fixtures coupled to a lower portion of the front portion for respective attachment to the first pair of fastening fixtures proximate the waist of the user; and a third pair of corresponding fastening fixtures coupled proximate to opposite sides of the head supporting portion for respective coupling to the third pair fastening fixtures, the pair of selectively retractable and extendable shoulder straps configured to be adjustable in length proximate the head of the child to allow the user to move the head supporting portion of the pouch toward or away from the user while maintaining support of the head of the child during the adjustment.

2. The baby carrier of claim 1, wherein the at least two adjustable straps form a figure 8-shaped arrangement crossing at the rear portions of the straps and being adjustable in length proximate a lower portion of the back portions of each of the at least two adjustable straps.

3. The baby carrier of claim 1, further comprising an intersection device for holding the at least two adjustable straps in relative relation to each other where the at least two adjustable straps cross.

4. The baby carrier of claim 1, wherein the plurality of fastening fixtures comprise male and female connections selected from the group comprising plastic domes, metal domes, plastic clips, metal clips, plastic hooks, metal hooks or combinations thereof.

5. The baby carrier of claim 1, wherein the pair of spaced apart upwardly extending portions are integrally formed with the front portion of the detachable pouch.

6. The baby carrier of claim 1, wherein the detachable pouch is comprised of padded fabric in a general five point configuration.

7. The baby carrier of claim 1, wherein the pouch system comprises a sliding fastening fixture disposed on the exterior of the front portion attached to a restraining loop.

8. The baby carrier of claim 1, wherein the at least one adjustable strap coupled to the laterally extending side portions for securing the laterally extending side portions at least partially about the torso of the child further comprise a pair of side straps with fastening fixtures disposed at each end thereof, the side straps being coupled together at the front of the child and in front of the front portion of the detachable pouch.

9. The baby carrier of claim 1, wherein the pair of selectively retractable and extendable shoulder straps further comprise a pair of sliding padded strips for providing padding to the pair of selectively retractable and extendable shoulder straps.

10. The baby carrier of claim 9, wherein each of the pair of sliding padded strips further comprise a loop for coupling the padded strip to the selectively retractable and extendable shoulder strap at the first ends thereof and a stop to prevent the retractable and extendable shoulder strap from separating from the adjustable shoulder harness.

11. The baby carrier of claim 1, further comprising a fourth pair of corresponding fastening fixtures at a lower portion of the back portion of the pouch for coupling to the first pair of fastening fixtures when the pouch is coupled to the adjustable shoulder harness when the back portion of the pouch is facing the user and wherein the third pair of fastening fixtures is configured to be coupled to the second pair of corresponding fastening fixtures of the pair of spaced apart upwardly extending portions by extending the pair of selectively retractable and extendable shoulder straps over the shoulders of the child positioned in a forward facing direction and positioning the pair of spaced apart upwardly extending portions against the upper torso of child proximate the shoulders.

12. The baby carrier of claim 11, wherein the pair of spaced apart upwardly extending portions of the pouch comprises a forked portion integrally formed with the front portion of the pouch, each portion of the fork being laterally spaced so as to allow the head of the child to be positioned there between when the child is in a forward facing direction.

13. The baby carrier of claim 1, further comprising a retractable draw string system having a pair of draw strings in a V-shaped configuration with first ends coupled to the pouch in a laterally spaced manner proximate the head portion and second ends extending through an opening in the pouch proximate the seat portion and coupled to a pull tab, whereby pulling on the pull tab causes the draw strings to pull the head portion closer to the seat portion to effectively shorten the length of the back portion of the pouch.

14. The baby carrier of claim 13, further comprising strips of self adhesive material proximate the opening with corresponding strips of self adhesive material attached to the pair of draw strings so that when the pair of drawstrings is folded onto the strips of self adhesive material, the draw strings can be held in place by the weight of the child bearing on the draw strings.

15. A baby carrier comprising;

a shoulder harness comprising a pair of straps, each having a shoulder portion configured for extending over a respective shoulder of a user, a front portion for extending over at least a chest of the user, a lower portion positioned proximate a waist of the user and a rear portion configured for extending around the back of the user, the front portions extending in front of the user, continuously from the shoulder portions to the lower portions, the at least two adjustable straps being laterally spaced along the front portions when positioned over the torso of the user;

a pouch formed of a relatively flat fabric structure having a generally five-point configuration when laid open and comprising a seat portion configured to extend between the legs of a child, a front portion integrally formed with the seat portion configured for extending over at least a portion of a front side of a torso of a child and including forked upper ends that extend from a top of the front portion over the chest of the child to proximate the shoulders of the child, a back portion including a head supporting portion configured for extending from a head of the child to the seat portion, the seat portion thus being interposed between the front portion and the back portion, and laterally extending side portions extending laterally from the back portion and configured to wrap at least partially around the torso of the child below the arms of the child and buckle together over the front portion with fastening fixtures disposed proximate each end of the laterally extending side portions for securing the side portions at least partially around the torso of the child and the front portion against the child;

a first pair of releasable fasteners coupled between the pouch and the shoulder harness in a laterally spaced apart manner proximate a front side of the seat portion of the pouch and a lower portion of the harness;

a second pair of releasable fasteners coupled between the forked upper ends of the pouch and the front portion of the shoulder harness;

a pair of selectively retractable and extendable shoulder straps, each attached at a first end to a respective shoulder portion of the shoulder harness and having a free second end, the first end being positioned and spaced above a point of attachment of the second pair of releasable fasteners to the shoulder harness and the pair of selectively retractable and extendable shoulder straps each being adjustable in length proximate the second end;

a third pair of releasable fasteners coupled between the second ends of the pair of selectively retractable and extendable shoulder straps and a head supporting portion of the pouch;

the pair of selectively retractable and extendable shoulder straps, when being adjusted from a retracted configuration to an extended configuration allows the user to move the head portion of the pouch and thus the head and upper torso of the child toward or away from the user while simultaneously maintaining support of the head of the child during the adjustment, the forked upper ends folding outward by the attachment of the forked upper ends to the front portion of the shoulder harness providing support of the torso of the child when the pair of selectively retractable and extendable shoulder straps are in the extended configuration.

16. The baby carrier of claim 15, wherein portions of he third pair of fastening fixtures attached to the selectively retractable and extendable shoulder straps are coupled to mating portions of the second pair of releasable fasteners coupled to the forked upper ends of the pouch so that the selectively retractable and extendable shoulder straps extend over the shoulders of the child when the pouch is oriented in a forward facing direction.

17. The baby carrier of claim 15, further comprising a fourth pair of fastening fixtures coupled to the pouch proximate a back side of the seat portion and coupled to a mating portion of the first pair of fastening fixtures when the pouch is oriented in a forward facing direction.

18. The baby carrier of claim 17, further comprising a fifth pair of fastening fixtures coupled to the back portion of the pouch below the head supporting portion and coupled to the second pair of fastening fixtures when the pouch is oriented in a forward facing direction.

19. The baby carrier of claim 15, further comprising a retractable draw string system having a pair of draw strings in a V-shaped configuration with first ends coupled to the pouch in a laterally spaced manner proximate the head portion and the second ends extending through an opening in the pouch proximate the seat portion and coupled to a pull tab, whereby pulling on the pull tab causes the draw strings to pull the head portion closer to the seat portion to effectively shorten the length of the back portion of the pouch.

20. The baby carrier of claim 19, further comprising strips of self adhesive material proximate the opening with corresponding strips of self adhesive material attached to the pair of draw strings so that when the pair of draw strings is folded onto the strips of self adhesive material, the draw strings can be held in place by the weight of the child bearing on the draw strings.

* * * * *